US010217398B2

(12) United States Patent
Yeh et al.

(10) Patent No.: US 10,217,398 B2
(45) Date of Patent: Feb. 26, 2019

(54) TEMPERATURE SENSING MODULE FOR DISPLAY DEVICE AND RELATED TEMPERATURE SENSING METHOD AND DISPLAY DEVICE

(71) Applicant: Sitronix Technology Corp., Hsinchu County (TW)

(72) Inventors: Chun-Chi Yeh, Hsinchu County (TW); Chih-Te Hung, Hsinchu County (TW)

(73) Assignee: Sitronix Technology Corp., Hsinchu County (TW)

( * ) Notice: Subject to any disclaimer, the term of this patent is extended or adjusted under 35 U.S.C. 154(b) by 0 days.

(21) Appl. No.: 15/597,163

(22) Filed: May 17, 2017

(65) Prior Publication Data

US 2018/0293930 A1 Oct. 11, 2018

(30) Foreign Application Priority Data

Apr. 11, 2017 (TW) ..... 106112005 A

(51) Int. Cl.
*G09G 3/20* (2006.01)
*G09G 3/34* (2006.01)
*G09G 3/36* (2006.01)

(52) U.S. Cl.
CPC ..... *G09G 3/2092* (2013.01); *G09G 3/3453* (2013.01); *G09G 3/3611* (2013.01); *G09G 2310/0243* (2013.01); *G09G 2320/041* (2013.01)

(58) Field of Classification Search
None
See application file for complete search history.

(56) References Cited

U.S. PATENT DOCUMENTS

2007/0216635 A1* 9/2007 Kondoh ..... G09G 3/3629 345/101
2016/0086540 A1* 3/2016 Kim ..... G09G 3/3233 345/214
2016/0203750 A1 7/2016 Lebrun

FOREIGN PATENT DOCUMENTS

CN 1542723 A 11/2004
CN 106356024 A 1/2017
TW I416459 B 11/2013

* cited by examiner

*Primary Examiner* — Gustavo D Polo
(74) *Attorney, Agent, or Firm* — Winston Hsu

(57) ABSTRACT

A temperature sensing module for a display device includes a temperature sensing routing, configured on a panel of the display device; and a temperature sensing unit, able to sense a resistance of the temperature sensing routing and generate a temperature indicating information according to the resistance; wherein the temperature indicating information indicates an operating temperature of an active area of the panel and is utilized to adjust at least one driving signal that controls the active area to display images.

9 Claims, 9 Drawing Sheets

TEMPERATURE SENSING MODULE FOR DISPLAY DEVICE AND RELATED TEMPERATURE SENSING METHOD AND DISPLAY DEVICE

BACKGROUND OF THE INVENTION

1. Field of the Invention

The present invention relates to a temperature sensing module for a display device, related temperature sensing method and related display device, and more particularly, to a temperature sensing module capable of accurately measuring an operating temperature of a display device, related temperature sensing method and related display device.

2. Description of the Prior Art

A liquid crystal display (LCD) is a flat panel display which has the advantages of low radiation, light weight and low power consumption and is widely used in various information technology (IT) products, such as notebook computers, personal digital assistants (PDA), and mobile phones. An active matrix thin film transistor (TFT) LCD is the most commonly used transistor type in LCD families, especially in the large-size LCD family. In addition, there are various kinds of electronic paper display system whose function is specifically for reading. The electronic paper is a charged polymer material comprising numbers of microspheres (e.g. capsules) and mimics the appearance and feature of a paper. The electronic paper not only equips with flexibility but also is able to repeatedly display images. Unlike LCD needs backlights, electronic paper displays are able to reflect ambient light to display images. Thus, information on the electronic paper is still distinct without viewing angle issue even under strong sunlight environment.

However, material features of either the liquid crystal molecules of the LCD or the charged polymer material of the electronic paper are affected by ambient temperature. For example, when the ambient temperature increases, a mobility of the charged polymer material increases; otherwise, the mobility of the charged polymer material decreases. Under such a condition, driving modules of the LCD and the electronic paper have to detect the ambient temperature, to generate proper driving signals according to the ambient temperature and to make the LCD and the electronic paper normally display images. If the driving modules cannot acquire accurate ambient temperature, the LCD and the electronic paper may display the images abnormally. Thus, how to acquire the precise ambient temperature of the LCD and the electronic paper becomes a topic to be discussed.

SUMMARY OF THE INVENTION

Thus, the present invention provides a temperature sensing module capable of accurately measuring an operating temperature of a display device, related temperature sensing method and related display device.

In an aspect, the present invention discloses a temperature sensing module for a display device. The temperature sensing module comprises a temperature sensing routing, configured on a panel of the display device; and a temperature sensing unit, able to sense a resistance of the temperature sensing routing and generate a temperature indicating information according to the resistance; wherein the temperature indicating information indicates an operating temperature of an active area of the panel and is utilized to adjust at least one driving signal that controls the active area to display images.

In another aspect, the present invention discloses a temperature sensing method for a display device. The temperature sensing method comprises sensing an operating temperature in a period when the display does not update images; and adjusting at least one driving signal of the display device according to the operating temperature.

In still another aspect, the present invention discloses a display device. The display device comprises a panel, comprising an active area for displaying images according to a plurality of driving signals; a driving module, able to generate the plurality of driving signals and adjust at least one of the plurality of driving signals according to a temperature indicating information; and a temperature sensing module, comprising a temperature sensing routing, configured on the panel of the display device; and a temperature sensing unit, able to sense a resistance of the temperature sensing routing and generate the temperature indicating information according to the resistance; wherein the temperature indicating information indicates an operating temperature of the active area of the panel.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
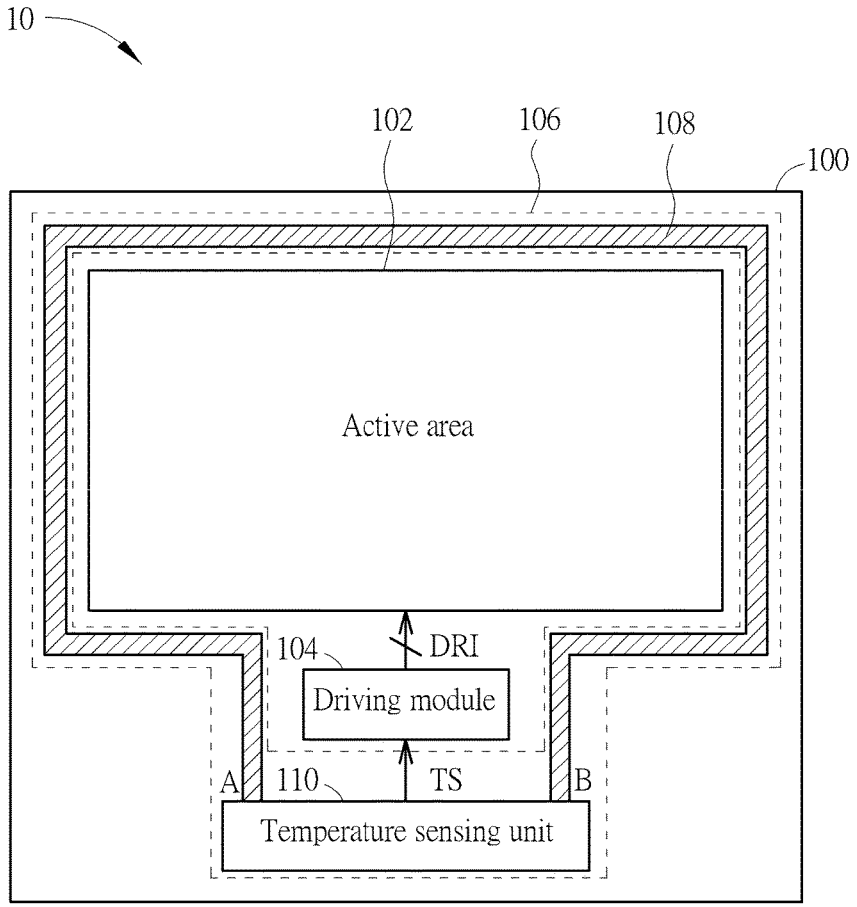
FIG. 1 is a schematic diagram of a display device according to an example of the present invention.

Please refer to FIG. 1, which is a schematic diagram of a display device 10 according to an example of the present invention. The display device 10 may be an electronic product with a display panel such as a smartphone, a tablet, and a laptop. FIG. 1 shows a panel 100, an active area 102, a driving module 104 and a temperature sensing module 106 and other components (e.g. a housing) do not directly relate to the concepts of the present invention are omitted for brevity. The panel 100 may be a liquid crystal panel consisting of glass substrates, metal layers, transparent conducting materials, color filters and liquid crystal molecules or an electronic paper panel consisting of glass substrates, metal layers, transparent conducting materials, and charged polymer materials. According to different applications and design concepts, the panel 100 can be realized by various methods. The panel 100 comprises the active area 102 utilized to display images according to a plurality of driving signals DRI generated by the driving module 104 (e.g. a driver integrated circuit). The temperature sensing module 106 comprises a temperature sensing routing 108 and a temperature sensing unit 100 and is utilized to sense an operating temperature of display components (e.g. pixels) in the active area 102 during operations and to accordingly generate a temperature indicating information TS to the driving module 104. As a result, the driving module 102 is able to properly adjust the driving signals DRI according to the operating temperature of the display components in the active area 102 during the operations, to make the active area 102 normally display images.

Generally, the temperature sensing module 106 of sensing temperature is configured in the driving module 104 to reduce a manufacturing cost of the display device 10. Under such a condition, the temperature sensed by the temperature sensing module 106 would be the operating temperature of the driving module 104 rather than the operating temperature of the display components in the active area 102. Because a power consumption of the continuous operations would significantly raise the operating temperature of the driving module 104, there would be a huge difference between the operating temperature of the driving module 104 and that of the display components in the active area 102. If the driving module 104 adjusts the driving signals DRI according to the operating temperature of itself, the display components in the active area 102 may work abnormally. In order to avoid the huge difference between the temperature sensed by the temperature sensing module 106 and the real operating temperature of the display components in the active area 102, the temperature sensing routing 108 shown in the example of FIG. 1 is configured on the panel 100. Since both the temperature sensing routing 108 and the active area 102 are configured on the panel 100, the temperature sensed by the temperature sensing module 106 approximates the real operating temperature of the display components in the active area 102. As a result, the driving module 104 is able to properly adjust the driving signals DRI according to the real operating temperature of the display components in the active area 102, to make the display components in the active area 102 normally display images.

In FIG. 1, the temperature sensing routing 108 is a conducting path extending from a node A to a node B and surrounding the active area 102. Note that, a resistance of the temperature sensing routing 108 has a temperature coefficient. That is, the resistance of the temperature sensing routing 108 varies with the operating temperature of the active area 102. By measuring the resistance of the temperature sensing routing 108, the temperature sensing unit 110 is able to determine the ambient temperature of the temperature sensing routing 108 (i.e. the operating temperature of the active area 102) and accordingly adjust the temperature indicating information TS. According to different applications and design concepts, the temperature sensing routing 108 may be implemented on the panel 100 by various methods. For example, the temperature sensing routing 108 may be a conducting path realized by an Indium Tin Oxide (ITO) layer, metal layers, a polysilicon layer, and/or an amorphous silicon layer. In another example, the temperature sensing routing 108 is a border display area of the panel 100, which is utilized to for displaying an outer frame.

According to the temperature indicating information TS generated by the temperature sensing unit 110, the driving module 104 adaptively adjusts the driving signals DRI. In an example, the driving module 104 increases voltages of the driving signals DRI, extends driving periods of the driving signals DRI or modifies driving waveforms of the driving signals DRI when the temperature indicating information TS indicates that the operating temperature of the active area 102 is too low, to make the display effects of the active area 102 consistent. For example, the maximum voltage of the driving signals DRI is a voltage VA when the temperature indicating information TS indicates that the operating temperature of the active area 102 is a room temperature. When the temperature indicating information TS indicates that the operating temperature of the active area 102 becomes smaller than the room temperature, the driving module 104 increases the maximum voltage of the driving signals DRI to a voltage VB greater than the voltage VA. Under such a condition, the display effect of the active area 102 is kept the same even if the operating temperature of the active area 102 drops.

In another example, the driving module 104 decreases the voltages of the driving signals DRI, shortens the driving periods of the driving signals DRI, or modifies the driving waveforms of the driving signals DRI when the temperature indicating information TS indicates that the operating temperature of the active area 102 is too high, to make the display effects of the active area 102 consistent. For example, the maximum voltage of the driving signals DRI is the voltage VA when the temperature indicating information TS indicates that the operating temperature of the active area 102 is the room temperature. When the temperature indicating information TS indicates that the operating temperature of the active area 102 becomes greater than the room temperature, the driving module 104 decreases the maximum voltage of the driving signals DRI to a voltage VC smaller than the voltage VA, to make the display effect of the active area 102 remain the same when the operating temperature of the active area 102 rises.

In FIG. 1, the temperature sensing unit 110 is configured on the panel 100. According to different applications and design concepts, the temperature sensing unit 110 may be configured in the driving module 104 or configured on a circuit board (e.g. a flexible circuit board) coupled to the panel 100.

Figure 2:
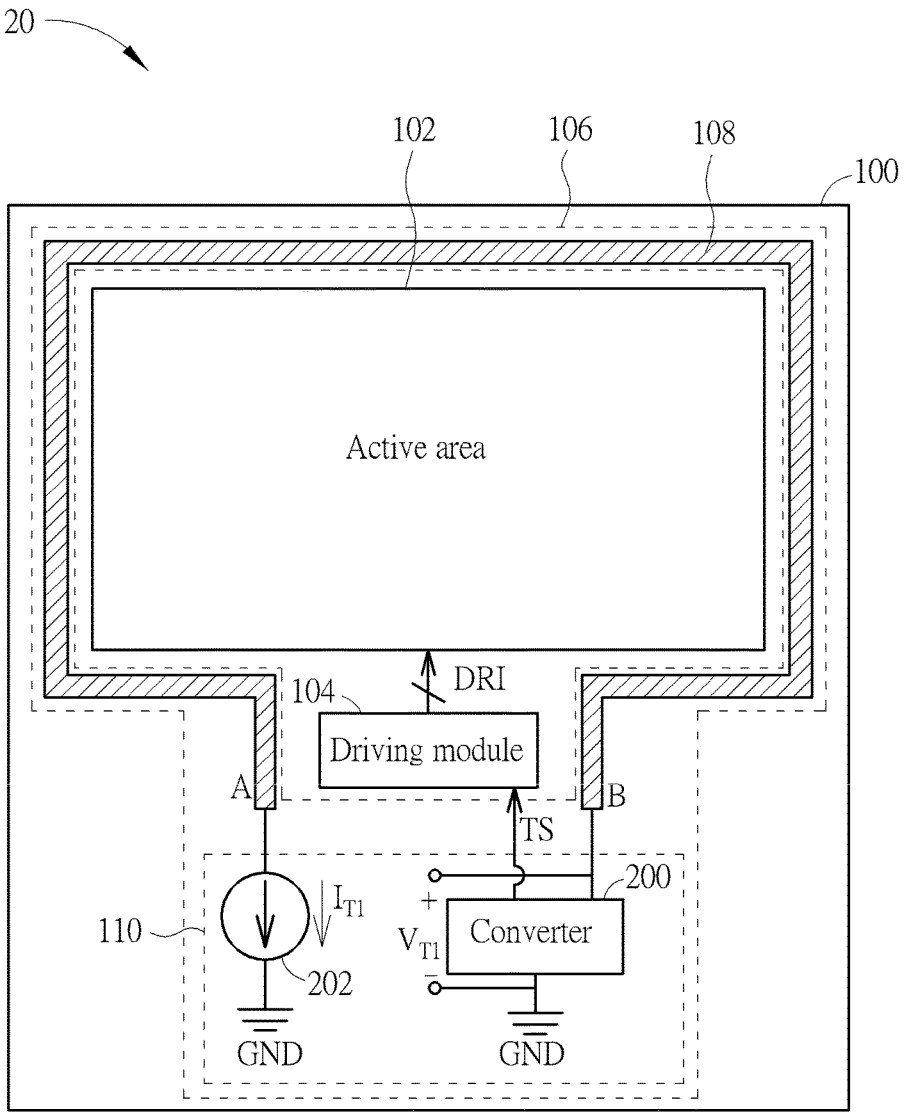
FIG. 2 is a schematic diagram of a display device according to an example of the present invention.

As to the implementation methods of the temperature sensing unit 110, please refer to the following examples. Please refer to FIG. 2, which is a schematic diagram of a display device 20 according to an example of the present invention. The display device 20 is similar to the display device 10 shown in FIG. 1, thus the components and signals with similar functions use the same symbols. In FIG. 2, the temperature sensing unit 110 comprises a converter 200 and a current source 202. The current source 202 is coupled to the node A or B of the temperature sensing routing 108 for providing a current $I_{T1}$. The converter 200 may be coupled to the nodes B and A of the temperature routing 108 for measuring a voltage difference $V_{T1}$ which is between the nodes B and A, and generated by the current $I_{T1}$. In an example, the converter 200 is an analog-to-digital converter. By dividing the voltage $V_{T1}$ by the current $I_{T1}$, the converter 200 acquires the resistance of the temperature sensing routing 108 and accordingly adjusts the temperature indicating information TS.

Figure 3:
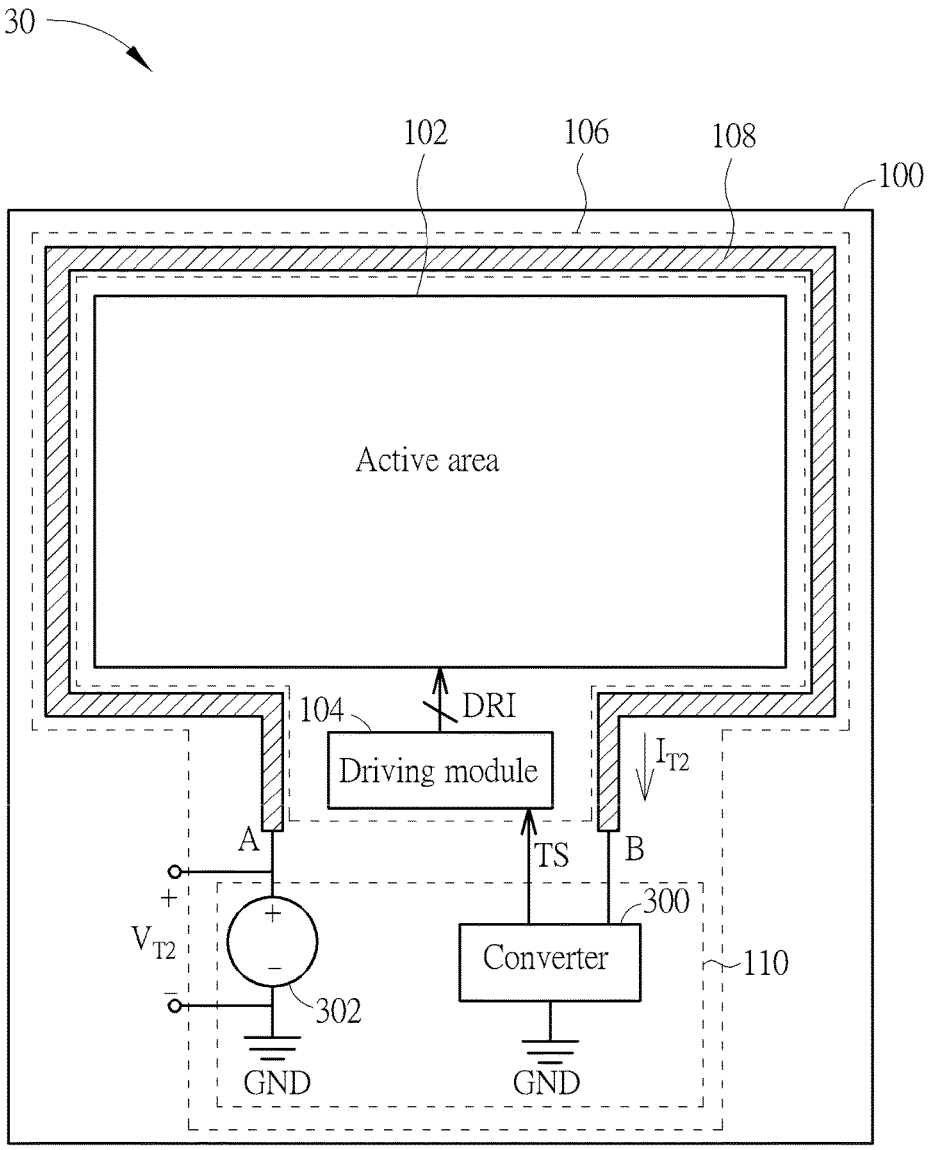
FIG. 3 is a schematic diagram of a display device according to an example of the present invention.

Please refer to FIG. 3, which is a schematic diagram of a display device 30 according to an example of the present invention. The display device 30 is similar to the display device 10 shown in FIG. 1, thus the components and signals with similar functions use the same symbols. In FIG. 3, the temperature sensing unit 110 comprises a converter 300 and a voltage source 302. The voltage source 302 is coupled to the node B or A of the temperature sensing routing 108 for providing a voltage $V_{T2}$. The converter 300 is coupled to the node B (or A) of the temperature sensing routing 108 for measuring a current $I_{T2}$ by which the voltage VT2 generated at the node B (or A). Via dividing the voltage $V_{T2}$ by the current $I_{T2}$, the converter 300 acquires the resistance of the temperature sensing routing 108 and accordingly adjusts the temperature indicating information TS.

Figure 4:
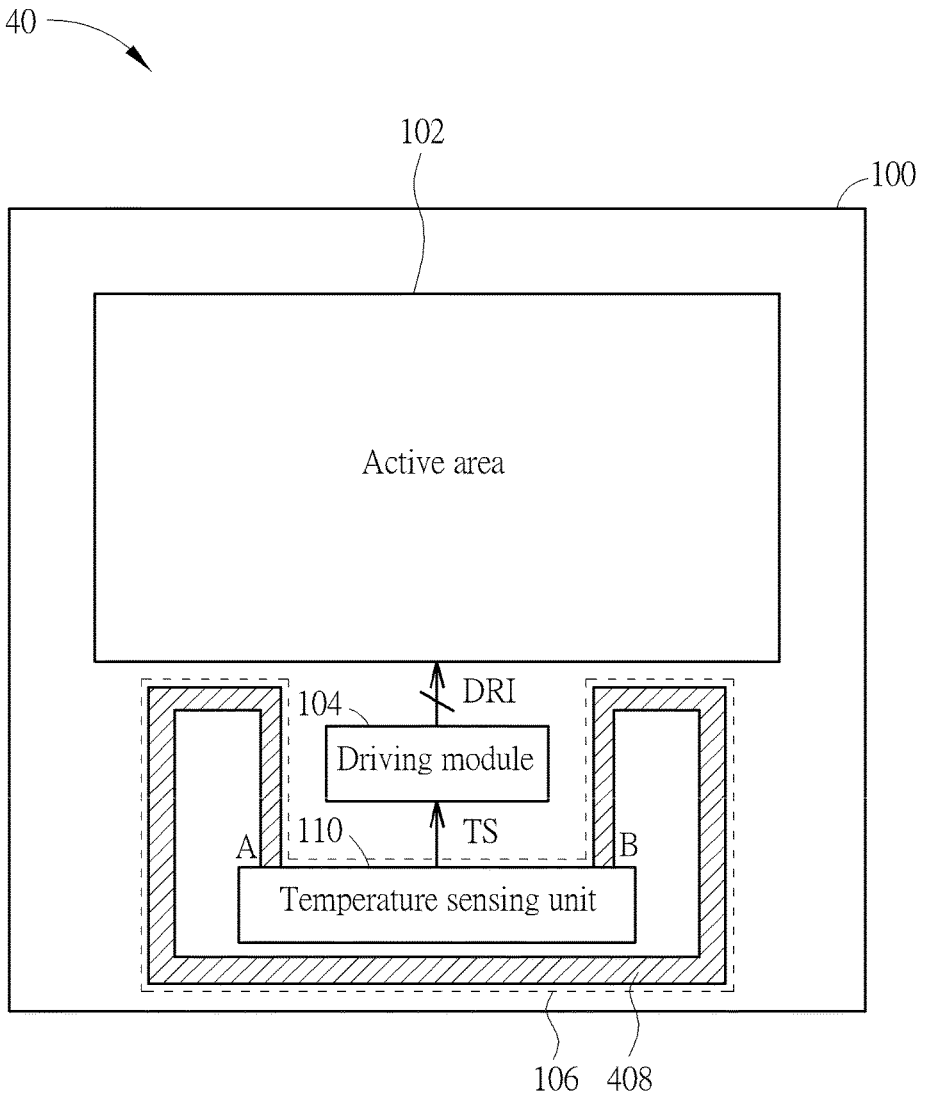
FIG. 4 is a schematic diagram of a display device according to an example of the present invention.

According to different applications and design concepts, the pattern of the temperature sensing routing 108 is not limited to the shape shown in FIG. 1. Please refer to FIG. 4, which is a schematic diagram of a display device 40 according to an example of the present invention. The display device 40 is similar to the display device 10 shown in FIG. 1, thus the components and signals with similar functions use the same symbols. Different from the temperature sensing routing 108, a temperature sensing routing 408 of the display device 40 passes through the bottom side of the panel 100. Because the temperature sensing routing 408 is configured on the panel 100, the operating temperature sensed by the temperature sensing unit 110 would not be affected by the driving module 106 and would approximate the real operating temperature of the display components in the active area 102.

Figure 5:
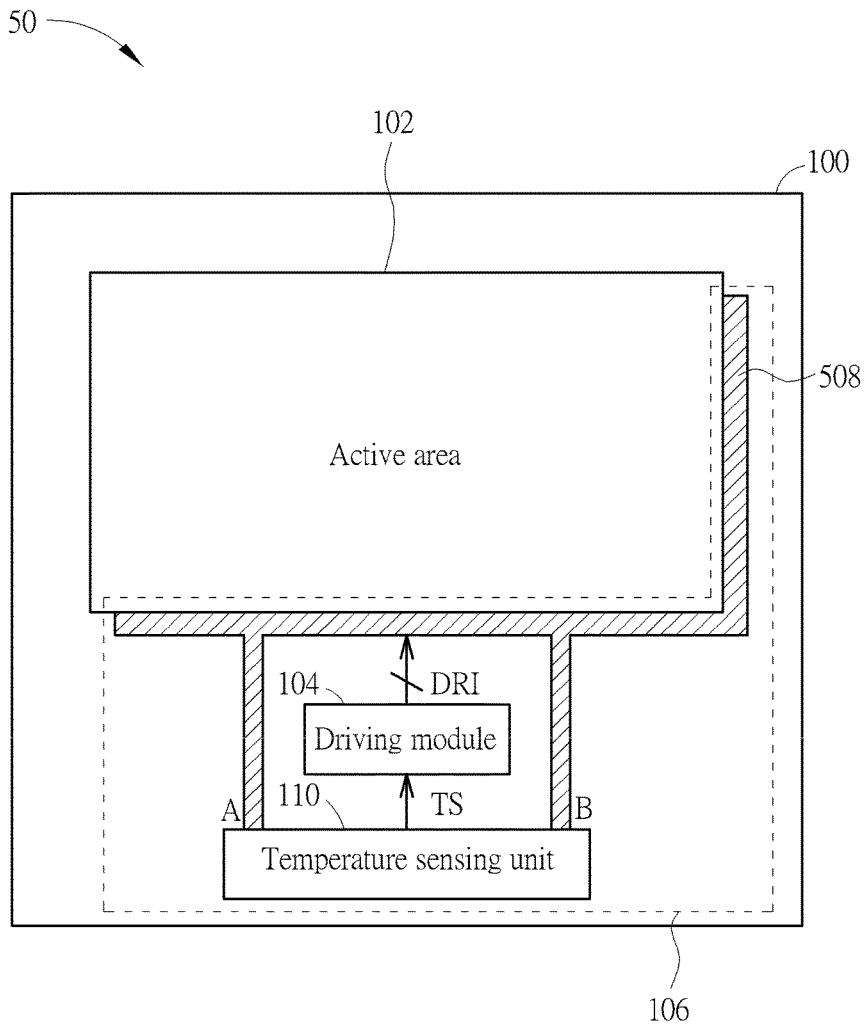
FIG. 5 is a schematic diagram of a display device according to an example of the present invention.

Please refer to FIG. 5, which is a schematic diagram of a display device 50 according to an example of the present invention. The display device 50 is similar to the display device 10 shown in FIG. 1, thus the components and signals with similar functions use the same symbols. Different from the temperature sensing routing 108 shown in FIG. 1 and the temperature sensing routing 408 shown in FIG. 4, a temperature sensing routing 508 of the display device 50 is configured in the active area 102. In this example, the temperature sensing routing 508 is a conducting path providing a common voltage VCOM in the active area 102. Comparing to FIGS. 1 and 4, a distance between display components in the active area 102 and the temperature sensing routing 508 is decreased. The operating temperature sensed by the temperature sensing unit 110 would further approximate the real operating temperature of the display components in the active area 102, therefore.

Figure 6:
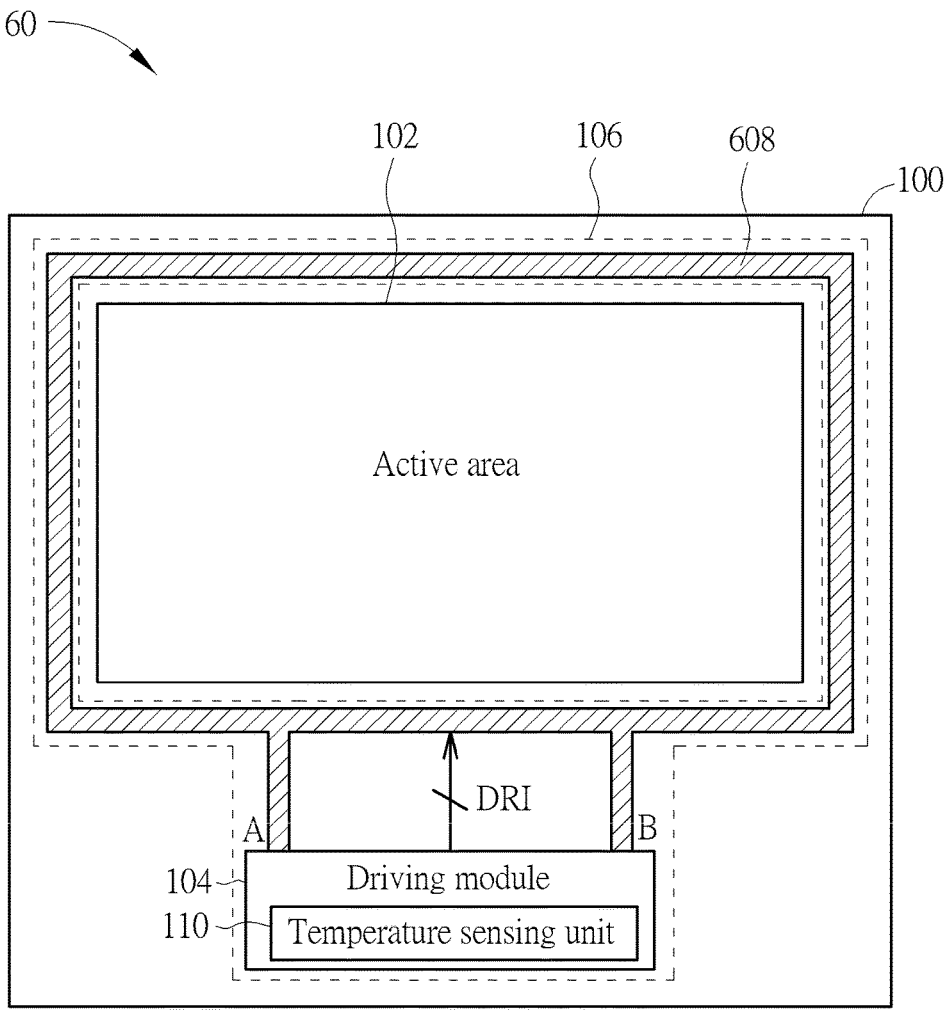
FIG. 6 is a schematic diagram of a display device according to an example of the present invention.

Please refer to FIG. 6, which is a schematic diagram of a display device 60 according to an example of the present invention. The display device 60 is similar to the display device 10 shown in FIG. 1, thus the components and signals with similar functions use the same symbols. Different the temperature sensing routing 108 shown in FIG. 1 partly surrounding the active area 102, a temperature sensing routing 608 of the display device 60 completely surrounding the active area 102. In addition, comparing to the display devices 10, 40, 50 shown in FIGS. 1, 4, and 5, the temperature sensing unit 110 shown in FIG. 6 is configured in the driving module 104.

Note that, the temperature sensing module 106 is able to not only sense the operating temperature of the display components in the active area 102 but also determine whether the panel 100 cracks. Because configured on the panel 100, the temperature sensing routing 108 may be disconnected when the panel 100 cracks, resulting in that the resistance of the temperature sensing routing 108 from node A to node B significantly increases. Under such a condition, the temperature sensing module 110 generates a crack indicating signal to an indication unit (e.g. a light-emitting diode (LED), not shown in FIG. 1) of the display device 10 when determining the resistance of the temperature sensing routing 108 exceeds a threshold, to make the indication unit generate an alarm signal (e.g. a visualized signal) for indicating that the panel 100 cracks; or, the temperature sensing module 110 stores the crack indicating signal in a storage unit (e.g. a register) accessible to external devices.

In order to further reduce effects from the driving module 104 to the temperature sensing module 106, the temperature sensing module 106 may sense the operating temperature when the driving module 104 does not update the images displayed by the active area 102. As a result, the operations of the temperature sensing module 106 sensing the operating temperature would not be affected by voltage variations on the voltage source of the display device 10 generated when the driving module 104 updates the images. The accuracy of sensing the operating temperature is further improved, therefore.

Figure 7:
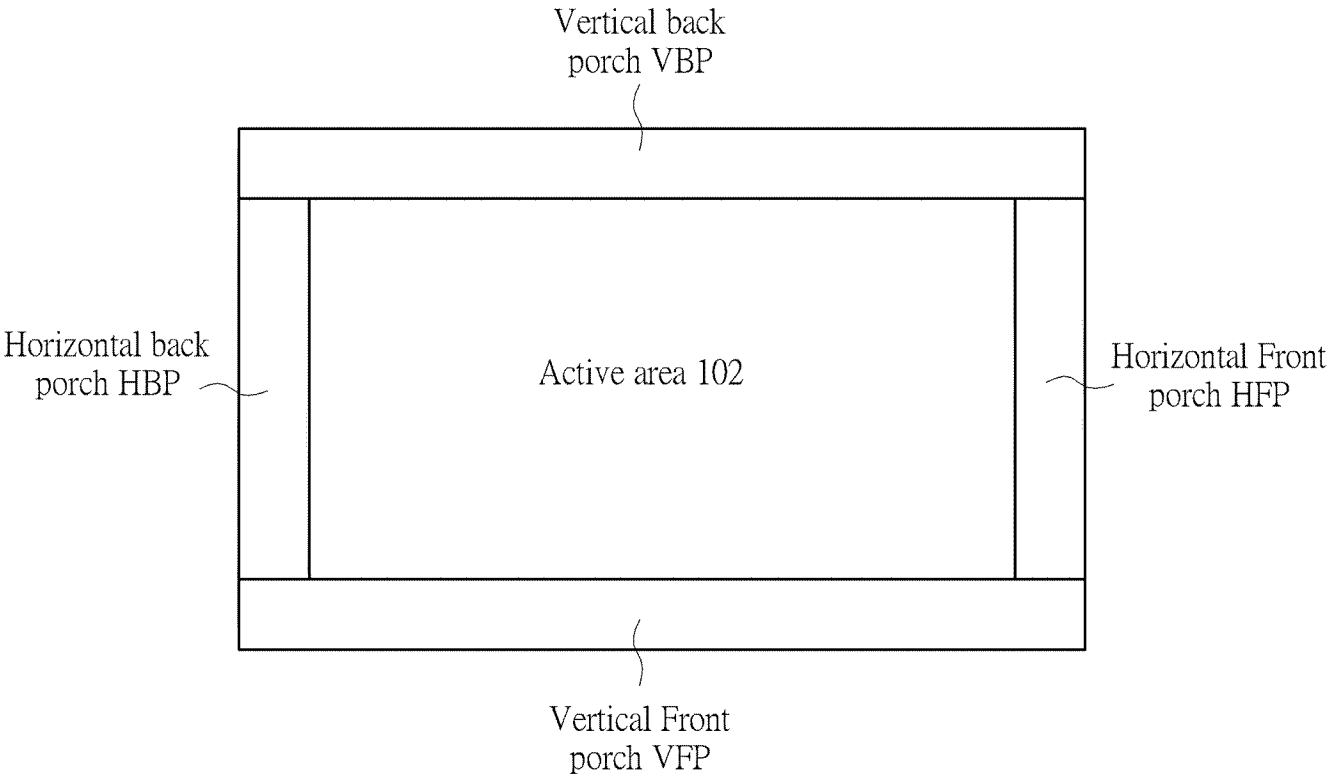
FIG. 7 is a timing diagram of a driving module updating images according to an example of the present invention.

Please refer to FIG. 7, which is a timing diagram of the driving module 104 updating the images according to an example of the present invention. In this example, the panel 100 is a liquid crystal panel. As shown in FIG. 7, the driving module 104 sequentially updates display voltage of the display components row by row via adjusting the driving signals DRI. Before the driving module 104 updates the display voltages of the display components from top to bottom and after the driving module 104 finishes updating the display voltages of the display components at the last row, there are a vertical back porch VBP and a vertical front porch VFP utilized as buffer periods. Similarly, before the driving module 104 updates the display voltages of the display components from left to right and after the driving module 104 finishes updating the display voltages of the display components at the last column, there are a horizontal back porch HBP and a horizontal front porch HFP utilized as the buffer periods. Within the vertical back porch VBP, the vertical front porch VFP, the horizontal back porch HBP and the horizontal front porch HFP, the driving module 104 does not consume a large amount of power consumption on generating the driving signals DRI. Thus, the temperature sensing module 106 senses the operating temperature of the display components in the active area 102 within the vertical back porch VBP, the vertical front porch VFP, the horizontal back porch HBP and/or the horizontal front porch HFP, to avoid that the operations of the driving module 104 affects the accuracy of sensing the operating temperature. In an example, the temperature sensing module 104 senses the operating temperature within the vertical back porch VBP and the vertical front porch VFP.

Figure 8:
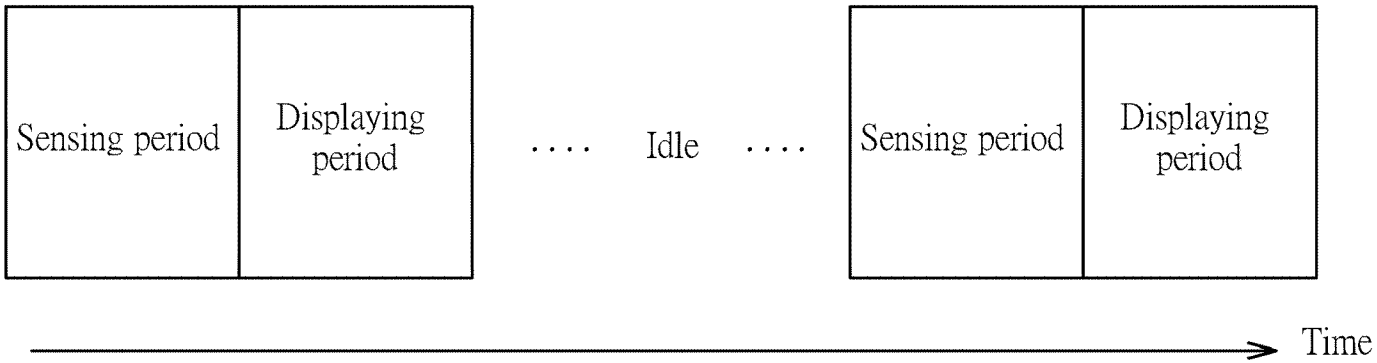
FIG. 8 is another timing diagram of a driving module updating images according to an example of the present invention.

Please refer to FIG. 8, which is a timing diagram of the driving module 104 updating the images according to an example of the present invention. In this example, the panel 100 is an electronic paper panel. Because the electronic paper panel is able to keep displaying image when the power is turned off, the driving module 104 turns off the power and enters an idle state after finishing updating the display voltages of the display components in the active area 102 within displaying periods, to reduce power consumption. As shown in FIG. 8, there is a sensing period before each displaying period. Within the sensing periods, the temperature sensing module 106 senses the operating temperature of the display components in the active area 102 and controls the driving module 104 to generate proper driving signals DRI in the displaying periods to update the display voltages of the display components in the active area 102. Since the driving module 104 stops operating within the sensing periods, the operations of the temperature sensing module 106 would not be affected by the driving module 104 and the accuracy of sensing the operating temperature is further enhanced.

Figure 9:
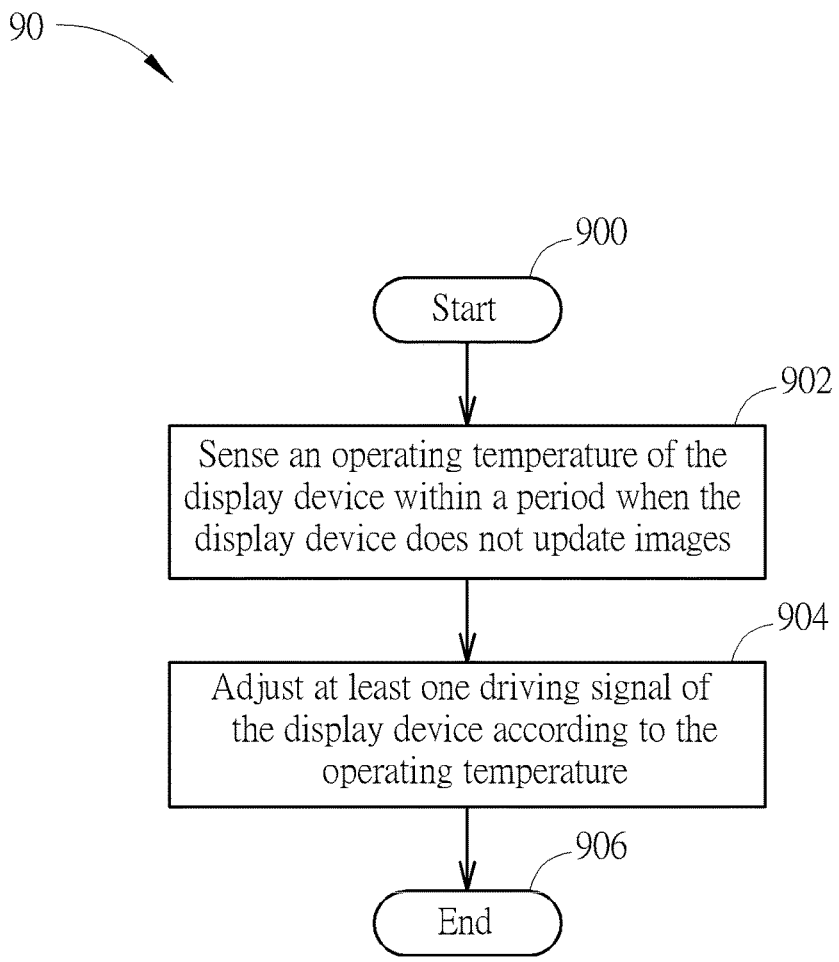
FIG. 9 is a flow chart of a temperature sensing method according to an example of the present invention.

The process of the temperature sensing module 106 sensing the operating temperature in the above examples can be summarized into a temperature sensing method 90. The temperature sensing method 90 can be utilized in a display device such as a liquid crystal display and an electronic paper display for controlling timings of a temperature sensing module in the display device starting operating. As shown in FIG. 9, the temperature sensing method comprises the following steps:

Step 900: Start.

Step 902: Sense an operating temperature of the display device within a period when the display device does not update images.

Step 904: Adjust at least one driving signal of the display device according to the operating temperature.

Step 906: End.

According to the temperature sensing method 90, the temperature sensing module senses an operating temperature of the display device (e.g. the operating temperature of an active area on a panel) within a period of the display device does not update images, to avoid that the accuracy of sensing the operating temperature is affected by the operations of the display device updating the images. According to the acquired operating temperature, the display device adjusts at least one driving signal (e.g. adjusting a magnitude of the at least one driving signal), to display the images normally.

In an example, the display device is a liquid crystal display and the temperature sensing module senses the operating temperature within intervals of the display device updating the images (e.g. a vertical back porch and a vertical front porch). In another example, the display device is an electronic paper display and the temperature sensing module senses the operating temperature of the display device within a sensing period before the display device updating the images.

The above examples allow the display device to acquire the real operating temperature of the display components by configuring the temperature sensing routing utilized for sensing the operating temperature on the panel of the display device. In addition, the above examples sense the operating temperature of the display components when the display device does not update the images, to prevent the accuracy of sensing the operating temperature of the display components from being affected by the operations of the display device updating the images.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A temperature sensing module for a display device, comprising:

a temperature sensing routing, configured on a panel of the display device; and a temperature sensing unit, able to sense a resistance of the temperature sensing routing and generate a temperature indicating information according to the resistance;

wherein the temperature indicating information indicates an operating temperature of an active area of the panel and is utilized to adjust at least one driving signal that controls the active area to display images;

wherein the temperature sensing unit senses the resistance of the temperature sensing routing within a period when the display device does not update images.

2. The temperature sensing module of claim 1, wherein the temperature sensing routing is configured in a boarder display area of the panel.

3. The temperature sensing module of claim 1, wherein the temperature sensing routing is configured in the active area.

4. The temperature sensing module of claim 1, wherein the temperature sensing routing surrounds the active area.

5. The temperature sensing module of claim 1, wherein the temperature sensing unit generate a crack indicating signal to an indication unit when the resistance of the temperature sensing routing exceeds a threshold.

6. A temperature sensing method for a display device comprising:

sensing a resistance of a temperature sensing routing configured on a panel of the display device to obtain an operating temperature of an active area of the panel in a period when the display does not update images; and adjusting at least one driving signal of the display device according to the operating temperature.

7. The temperature sensing method of claim 6, wherein the display is a liquid crystal display and the period is at least one of a vertical back porch, a vertical front porch, a horizontal back porch, and a horizontal front porch.

8. The temperature sensing method of claim 6, wherein the display device is an electronic paper and the period is a sensing period before the display device updates the images.

9. A display device, comprising:

a panel, comprising an active area for displaying images according to a plurality of driving signals;

a driving module, able to generate the plurality of driving signals and adjust at least one of the plurality of driving signals according to a temperature indicating information; and a temperature sensing module, comprising:

a temperature sensing routing, configured on the panel; and a temperature sensing unit, able to sense a resistance of the temperature sensing routing and generate the temperature indicating information according to the resistance;

wherein the temperature indicating information indicates an operating temperature of the active area of the panel;

wherein the temperature sensing unit senses the resistance of the temperature sensing routing within a period when the display device does not update images.

* * * * *